US007444835B2

(12) United States Patent
Mehta

(10) Patent No.: US 7,444,835 B2
(45) Date of Patent: Nov. 4, 2008

(54) CREATING ILLUSION OF LARGE GEMSTONES

(76) Inventor: Nihar Mehta, 902 Jamuna Niketan Building, Manav Mandir Road, Mumbai (IN) 400 006

( * ) Notice: Subject to any disclaimer, the term of this patent is extended or adjusted under 35 U.S.C. 154(b) by 153 days.

(21) Appl. No.: 11/308,499

(22) Filed: Mar. 30, 2006

(65) Prior Publication Data

US 2007/0234758 A1 Oct. 11, 2007

(51) Int. Cl.
*A44C 17/02* (2006.01)

(52) U.S. Cl. ..... 63/28; 63/26

(58) Field of Classification Search ..... None
See application file for complete search history.

(56) References Cited

U.S. PATENT DOCUMENTS

| | | | | |
|---|---|---|---|---|
| 5,377,506 | A | 1/1995 | Tranzer | |
| 6,318,121 | B1 | 11/2001 | Pachauer | |
| 6,532,765 | B1 | 3/2003 | Hurwitz | |
| 6,591,633 | B2 | 7/2003 | Pachauer | |
| 2005/0188722 | A1 * | 9/2005 | Nevatia et al. | 63/26 |
| 2005/0210677 | A1 | 9/2005 | Yakubovich | |

FOREIGN PATENT DOCUMENTS

| | | | |
|---|---|---|---|
| GB | 2368774 | A | 8/2000 |
| GB | 2384685 | A | 8/2000 |
| WO | WO 01/12008 | A1 | 2/2001 |
| WO | WO 02/41724 | A1 | 5/2002 |

OTHER PUBLICATIONS

Gerald L, Lewy, "Ganoksin Setting Gemstones in Wax", Excerpts from "Manual of Diamond Setting", downloaded from the web on Feb. 13, 2006, pp. 1-4. www.NorthernRefinertes.com.

* cited by examiner

*Primary Examiner*—Jack W. Lavinder
(74) *Attorney, Agent, or Firm*—Narendra Reddy Thappeta

(57) ABSTRACT

Creating the illusion of a larger diamond from smaller diamonds. In an embodiment, four corner diamonds (of circular shape and equal size) are placed in four corners of a square area and a center diamond is placed in the gap presented by the four corner diamonds. The center diamond is placed at a level below that of the four corner diamonds and is supported by a rim such that the center diamond does not have to rely on the corner diamonds for support. The rim supports the center diamond at about 90-95% of its pavilion height in one embodiment. Prongs are used in addition to support the corner diamonds.

9 Claims, 5 Drawing Sheets

CREATING ILLUSION OF LARGE GEMSTONES

BACKGROUND OF THE INVENTION

1. Field of the Invention

The present invention relates generally to gemstones, and more specifically to a method and apparatus for creating illusion of larger diamonds.

2. Related Art

Gemstone is a precious or semi-precious stone used in jewelry. An example of a gemstone is a diamond which can be used in various jewelry such as rings, necklaces and bracelets. There is a long felt need for large gemstones due to the perceived better aesthetics. However, large gemstones are often not available in abundance leading to correspondingly high market value.

Accordingly, there is a general recognised need in the industry to at least create illusion of a large gemstone using smaller gemstones so that the costs can be maintained low.

In one prior approach, multiple diamonds are used and at least one of the diamonds (usually the one set to be at the center) is set and held in position by the pressure of adjacent diamonds. The pressure of the adjacent diamonds could result in damaging of the center diamond, and accordingly such an approach may also be undesirable in several situations.

Accordingly in an alternative approach, illusion of large diamond is created by cutting a groove into multiple diamonds and running metal through the grooves to hold the diamonds together (thereby creating illusion of a large diamond). One drawback with such an approach is the diamonds would not have resale value due to the alterations resulting from the groove and accordingly such an approach is often undesirable.

Therefore what is needed is an improved approach which creates illusion of larger gemstones from smaller gemstones, while overcoming at least some of the disadvantages (or meeting the general market requirements) noted above.

BRIEF DESCRIPTION OF THE DRAWINGS

The present invention will be described with reference to the accompanying drawings briefly described below.

FIG. (FIG.) 1 is a diagram illustrating the terminology used associated with various portions of a diamond.

In the drawings, like reference numbers generally indicate identical, functionally similar, and/or structurally similar elements. The drawing in which an element first appears is indicated by the leftmost digit(s) in the corresponding reference number.

DETAILED DESCRIPTION OF THE PREFERRED EMBODIMENTS

I. Overview

A jewelry provided according to an aspect of the present invention contains four gemstones having a circular shape from a top view and placed covering a rectangle area such that a gap would be present between the four gemstones. A fifth gemstone is then located in the gap without being supported by any of the four gemstones. The five gemstones together provide an illusion of a larger rectangular gemstone since the fifth gemstone substantially fills the gap created by the four gemstones. Since the fifth gemstone is not supported by the remaining gemstones, lateral pressures from the gemstones are avoided, thereby overcoming the possibility of damage (to any of the gemstones, in particular the fifth one).

In an embodiment in which illusion of a larger rectangular diamond is created, all the five diamonds are circular in shape from a top view and the fifth diamond (i.e., the one placed in the gap) is smaller in size compared to each of the remaining four diamonds. The four diamonds are held in place by a set of prongs provided as a part of a mount structure. The mount structure further includes a circular rim to hold the fifth diamond at over 90% pavilion height and to place the fifth diamond at a lower level than the remaining four diamonds.

Several aspects of the invention are described below with reference to examples for illustration. It should be understood that numerous specific details, relationships, and methods are set forth to provide a full understanding of the invention. One skilled in the relevant art, however, will readily recognize that the invention can be practiced without one or more of the specific details, or with other methods, etc. In other instances, well known structures or operations are not shown in detail to avoid obscuring the features of the invention.

The description is continued with reference to the general structure of a diamond used to illustrate various features of the present invention in an example embodiment.

II. Diamond

Figure 1:
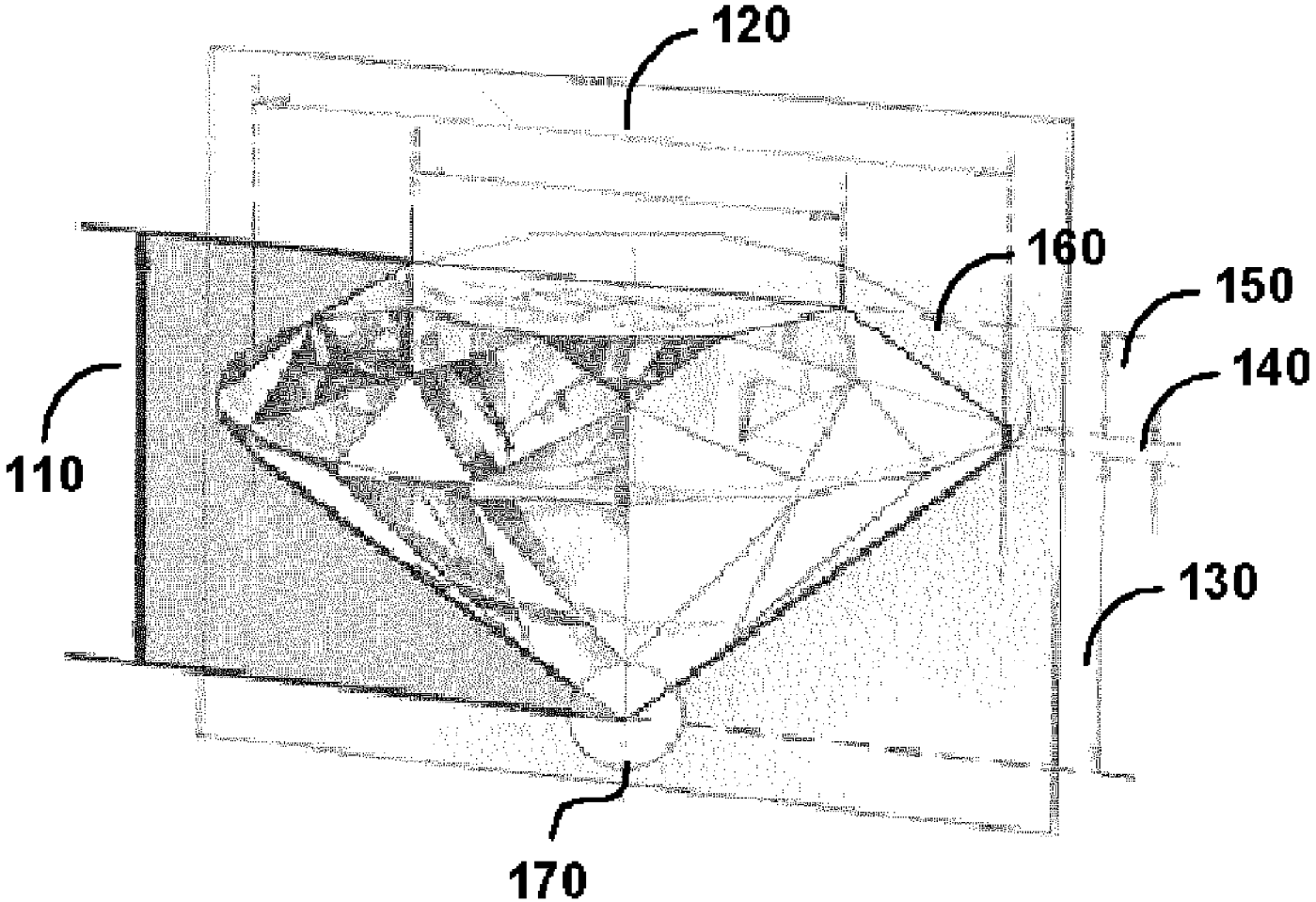

FIG. 1 is a diagram of diamond 100 illustrating the terminology use associated with various portions. Only the portions of the diamond that as relevant to illustrating various aspects of the present invention are described briefly below.

Table 180 represents the top most portion and is generally the largest facet of diamond 100. Portion 160 corresponds to a circular top (from top view) indicating that the diamond represented in FIG. 1 corresponds to a circular diamond. Accordingly, the length of line 120 represents the diameter of the circular top portion 160 of the diamond. The magnitude of the diameter of the circular top represents the size of the diamond. Thus, a smaller diamond would have a correspondingly smaller diameter.

Portion 150 is generally known as the crown of the diamond and represents the sloped portion from table 180 to girdle 140. Portion 140 represents the girdle and is located between crown 150 and pavilion 130. Portion 130 represents a pavilion, which extends inwardly and downwardly from girdle 140 towards culet 170. Line 110 represents the depth of the diamond and is measured as the height from culet 170 to table 180.

The description is continued with an illustration of how an illusion of a large square diamond can be created using small circular diamonds in an embodiment of the present invention.

III. Jewelry with Large Square Diamond

Figure 2:
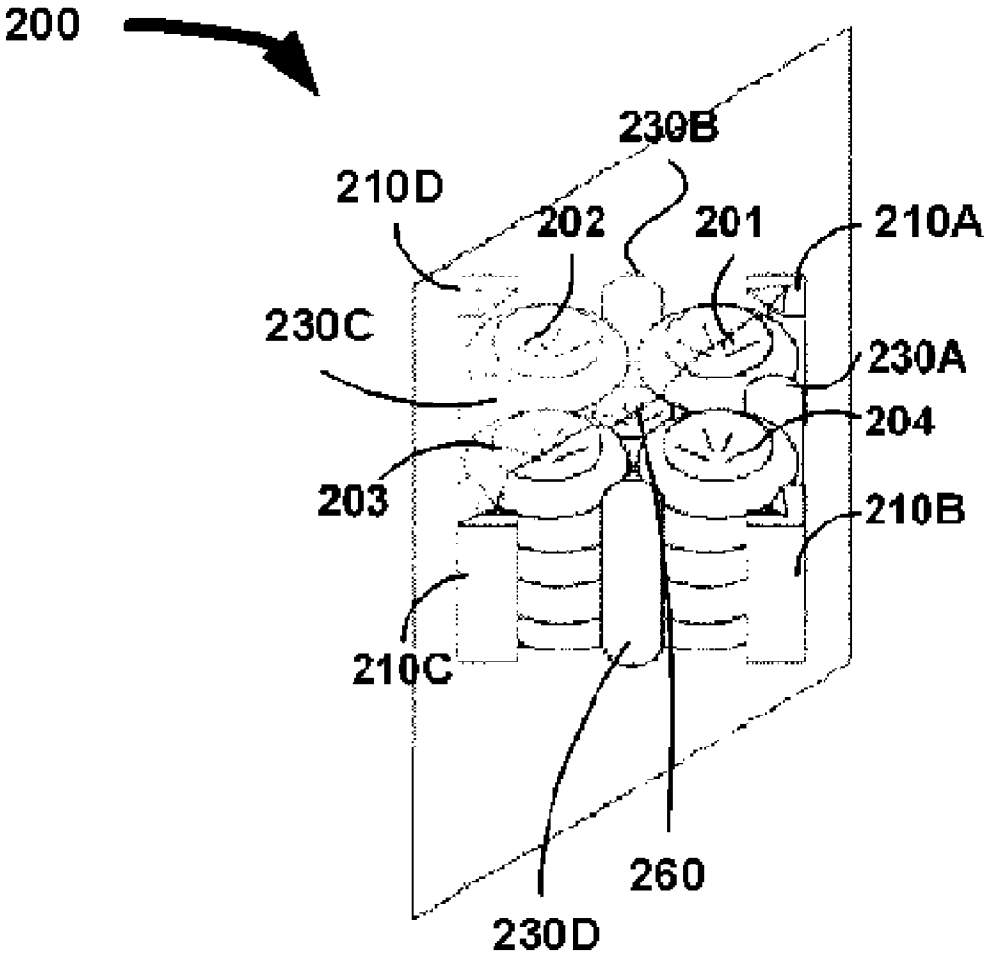
FIG. 2 is a diagram illustrating a jewelry containing a setting of diamonds to create an illusion of a large diamond in an embodiment implementing several aspects of the present invention.

FIG. 2 illustrates the details of jewelry 200 containing five smaller diamonds on a mount (described in further detail in FIGS. 3A-3E below) to create an illusion of a large square diamond in an embodiment of the present invention. The five diamonds sought to be set are indicated by 201, 202, 203, 204 and 260 and are circular in shape (from a top view) in the illustrative embodiment. Diamonds 201,202, 203 and 204 are set covering a rectangular portion of the mount thereby creating a gap in the center to hold diamond 260.

Diamond 260 is placed in the gap formed by the four corner diamonds 201-204. Diamond 260 is selected to be smaller in size (smaller diameter from a top view) than the other four diamonds 201,202, 203 and 204 and also to be of sufficient size to substantially fill the gap. In addition, diamond 260 is shown mounted at a height slightly below the level of the remaining four diamonds 201-204. By filling the gap and placing diamond 260 below the corner diamonds 201-204, the amount of visible metal (from the mount below) mount may be reduced, thereby enhancing the appearance of jewelry 200.

Each corner prong 210A, 210B, 210C and 210D is shown with a V-shape, and holds the corresponding one of corner diamonds 201-204 in the respective position of the rectangular area in conjunction with a pair of circular prongs 230A-230D. The corner prongs preferably need to provide enhanced contact (with appropriate curvature shape) with the corresponding corner diamond such that the diamond would be held in place with less pressure/unit area.

Two of circular prongs (230A-230D) together with the corresponding corner prong (210A-210D) hold each of the four corner diamonds 201-204 around the girdle of the diamond at their respective positions. Corner prongs 201-204 support in holding the corresponding corner diamond in position by a clamping action on the crown. For example, prongs 210A, 230A and 230B together hold diamond 201 in position. Similarly, diamonds 202, 203 and 204 are held in position by the set of prongs {210D, 230B, 230C}, {210C, 230C, 230D} and {210B, 230D,230A} respectively.

As may be appreciated from the illustration above, each of the circular prongs 230A, 230B, 230C and 230D holds one pair of diamonds. Due to such an arrangement (along with the appropriate mounting of diamond 260, as described below), the lateral pressure on each of the diamonds may be reduced.

According to an aspect of the present invention, center diamond 260 is set firmly on a mount with the support of a circular rim below the girdle such that the center diamond does not depend on the side diamonds (thereby reducing the lateral pressure) for support, as described below with respect to FIGS. 3A-3E.

IV. Mount and Mounting

Figure 3A:
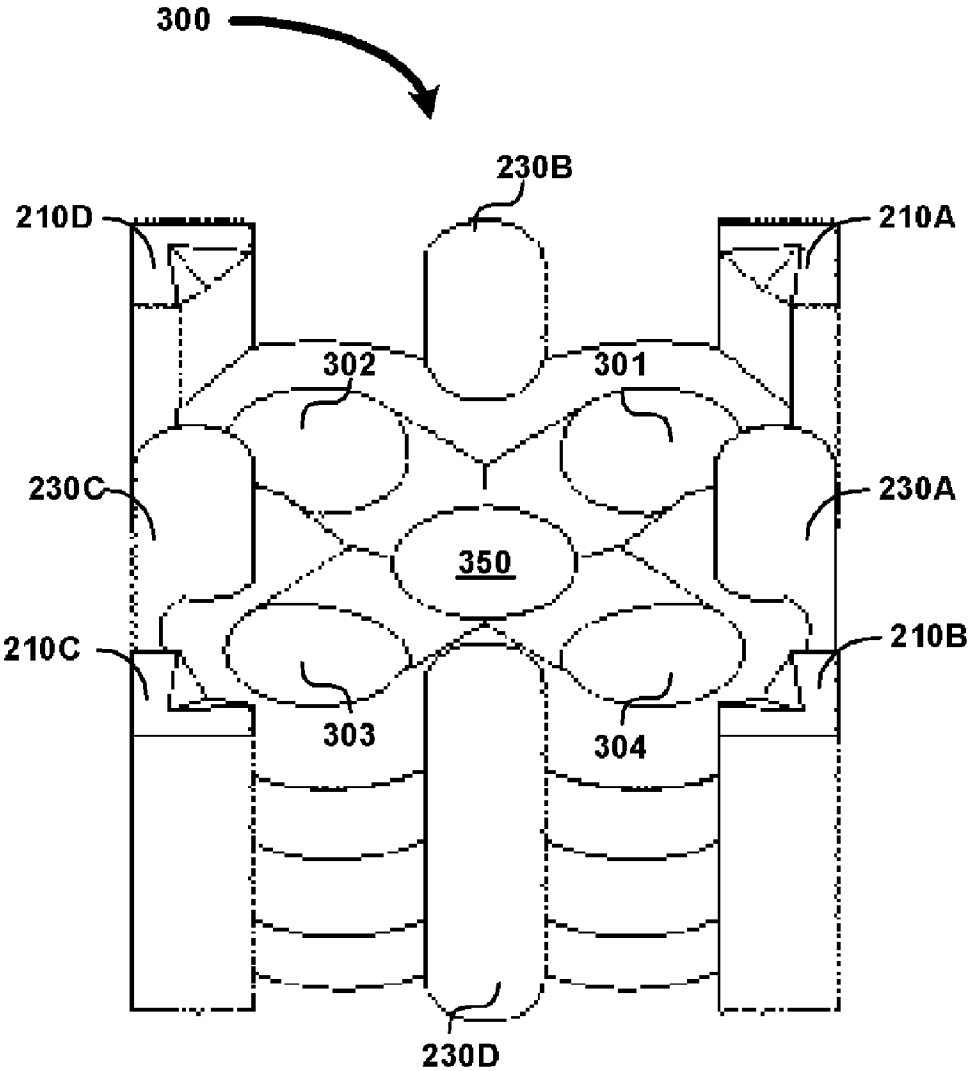
FIGS. 3A and 3B are diagrams illustrating a metal base/mount used for setting the diamonds in an embodiment implementing several aspects of the present invention.
Figure 3B:
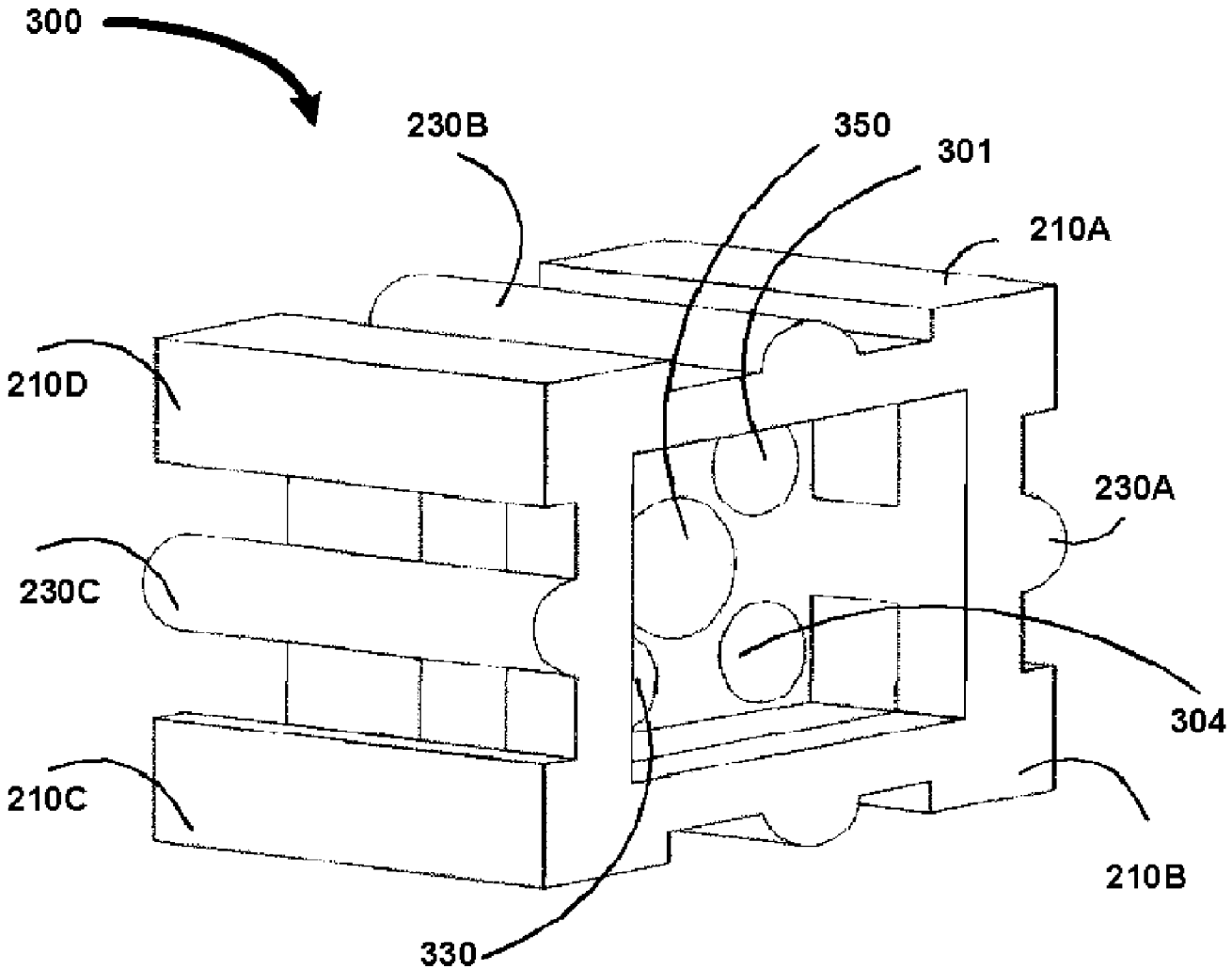

FIGS. 3A-3E together illustrate the manner in which the jewelry of FIG. 2 can be manufactured in an example scenario. In particular, FIG. 3A depicts a top view of metal base/mount 300 containing metal rims 301-304 and 350, corner prongs 210A-210D and circular prongs 230A-230D. FIG. 3B contains the corresponding side view of mount 300. The same element numbers are used in both FIGS. 3A and 3B for easy correlation of the corresponding parts.

Metal rims 301-304 represent placeholders (seats) on which the corresponding diamonds 201-204 respectively rest, say at less than 70% of corresponding pavilion height. Along with the clamping action of the three prongs, the metal rims hold the corner diamonds firmly in place. Assuming the corner stones are mounted firm, the area above rim 350 would represent a gap present between the corner diamonds. Rim 350 holds center diamond 260.

As noted above, center diamond 260 would be placed in the gap at a level below the four corner diamonds, thereby creating an illusion of a larger gemstone. However, in one realistic scenario, center diamond 260 is mounted first followed by the other diamonds, as described below in further detail.

Figure 3C:
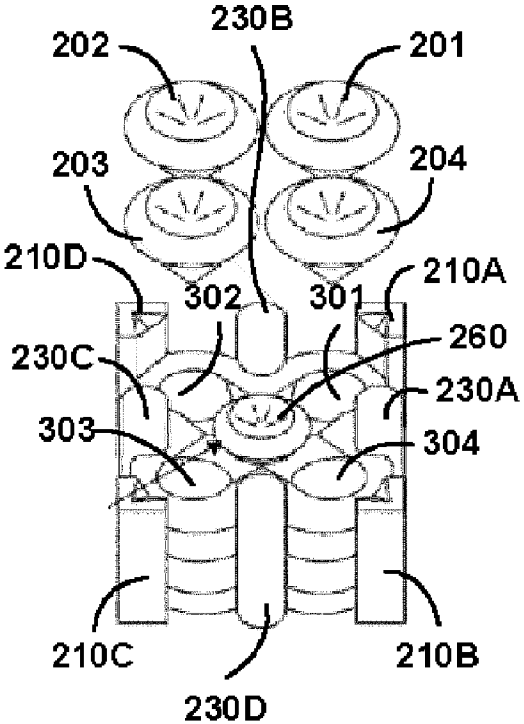
FIG. 3C depicts the manner in which a center diamond is first set on a mount in an embodiment of the present invention.

FIG. 3C illustrates the setting of diamonds 201, 202, 203 and 204 in corresponding portions 301, 302, 303 and 304 respectively. As shown there, diamond 260 is shown set in metal rim 350 first before setting of the corner diamonds 201_204. As described above with reference to FIGS. 3A and 3B, diamond 201 is mounted in rim 301 and held in place by metal prongs 210A, 230A and 230B. The location/support of other diamonds is described similarly.

Figure 3D:
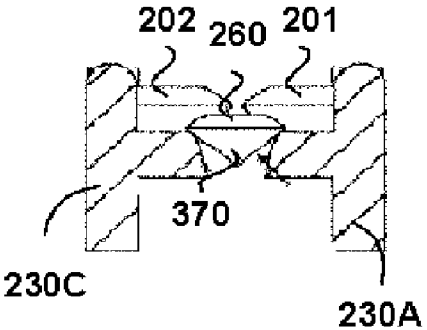
FIGS. 3D and 3E contain diagrams illustrating corresponding different views of the center diamond set on the metal base of a jewelry manufactured in an embodiment of the present invention.

FIG. 3D depicts a cross sectional view of mount 300, when cut by at a hypothetical logical plane formed by central pongs 230A and 230C. As can be readily observed, center diamond 260 is held in position by rim 350 below girdle at 90-95% of pavilion height. The description is continued with an illustration of another cross sectional view of mount 300, when mount 300 is cut diagonally (by a hypothetical plane formed by corner prongs 210C and 210A), as shown in FIG. 3E.

Figure 3E:
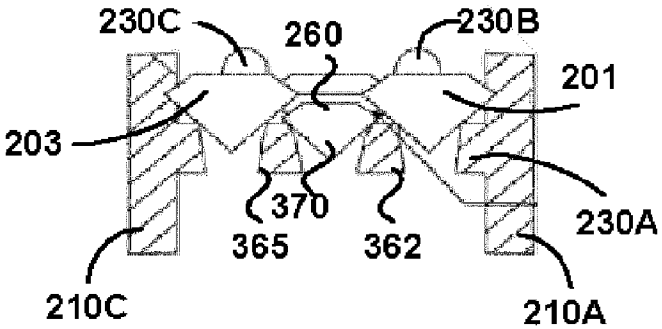

As indicated in FIG. 3E, center diamond 260 is supported by circular rim 350, portions of which are as indicated by 362 and 365. The circular rim holds center diamond 260 in gap 350 at 90-95% of the pavilion height in one embodiment. However, the diamond can be clamped at a different height depending on the dimensions of the center diamond, but the center diamond needs to be placed at a level lower than corresponding (common) level of corner diamonds 201-204.

The circular rim is hidden below the girdle of diamond 260 and hence is not visible from the top thereby creating an illusion of a large diamond along with the setting of other corner diamonds 201-204.

While a circular rim is shown holding the center diamond in the gap formed by the four corner stones, it should be appreciated that alternative techniques can be used to hold the center diamond in similar position in alternative embodiments. For example, center diamond may be held in place using grooving technique, in which the diamond is grooved below the girdle and held in place by running a metal. However, such approaches would damage the diamond, in addition to potentially leading to higher manufacturing costs.

Similarly, different sizes of diamonds for the gemstones can be used to provide jewelry without departing from the scope and spirt of the some aspects of the present invention, as will be apparent to one skilled in the relevant arts by reading the disclosure provided herein.

CONCLUSION

While various embodiments of the present invention have been described above, it should be understood that they have been presented by way of example only, and not limitation. Thus, the breadth and scope of the present invention should not be limited by any of the above described exemplary embodiments, but should be defined only in accordance with the following claims and their equivalents.

What is claimed is:

1. An article of manufacture comprising:

four gemstones having a circular shape from a top view, said four gemstones being placed covering a rectangle area such that a gap would be present between said four gemstones, wherein said rectangle area is of a square shape;

a fifth gemstone located in said gap without being supported by any of said four gemstones; and a rim to hold said fifth gemstone firmly in said gap such that said fifth gemstone would be held in place even in the absence of said four gemstones, wherein said rim holds said fifth gemstone at over 90% of pavilion height of said fifth gemstone, whereby said four gemstones along with said fifth gemstone provide an illusion of a larger gemstone with a size greater than any of said four gemstones and said fifth gemstone, wherein all of said four gemstones are set at a same level and said fifth gemstone is placed at a level lower than said same level, and a mount structure containing said rim holding said fifth gemstone, four corner prongs and four central prongs, each of said four gemstones being held in a corresponding position by two of said four central prongs, and one of said four corner prongs, said four corner prongs giving said square shape to said area in which said four gemstones are placed.

2. The article of manufacture of claim 1, wherein said mount structure further comprises four additional rims, wherein each of said four gemstones rests on a corresponding one of said four additional rims.

3. The article of manufacture of claim 2, wherein each of said corner prongs has a curvature shape to hold a corresponding one of said four gemstones at a substantial portion of a crown, and wherein said each of said four central prongs is of circular shape.

4. The article of manufacture of claim 1, wherein each of said four gemstones and said fifth gemstone comprises a diamond.

5. A jewelry comprising:

four gemstones having a circular shape from a top view, said four gemstones being placed covering a rectangle area such that a gap would be present between said four gemstones, wherein said rectangle area is of a square shape;

a fifth gemstone located in said gap;

a support element holding said fifth gemstone around its pavilion such that said fifth gemstone is without being supported by any of said four gemstones, wherein said support element holds said fifth gemstone at over 90% of pavilion height of said fifth gemstone, wherein said support element comprises a rim to hold said fifth gemstone firmly in said gap such that said fifth gemstone would be held in place even in the absence of said four gemstones, wherein all of said four gemstones are set at a same level and said fifth gemstone is placed at a level lower than said same level, whereby said four gemstones along with said fifth gemstone provide an illusion of a larger gemstone with a size greater than any of said four gemstones and said fifth gemstone, and a mount structure containing five rims, four corner prongs and four central prongs, each of said four gemstones being held in a corresponding position by two of said four central prongs, and one of said four corner prongs, each of said four gemstones resting on a corresponding one of four of said five rims, said four corner prongs giving said square shape to said area in which said four gemstones are placed, said five rims containing said support element holding said fifth gemstone.

6. Thejewelry of claim 5, wherein each of said corner prongs has a curvature shape to hold a corresponding one of said four gemstones at crown, and wherein said each of said four central prongs is of circular shape.

7. A method of setting gemstones to create an illusion of a larger gemstone, said method comprising:

setting four gemstones covering a rectangle substantially such that a gap would be present between said four gemstones, wherein said rectangle is a square; and setting a fifth gemstone in said gap such that said fifth gemstone is not supported by any of said four gemstones, wherein all of said four gemstones are set at a same level and said fifth gemstone is placed at a level lower than said same level, wherein a metal holds said fifth gemstone at over 90% of pavilion height of said fifth gemstone, whereby said four gemstones along with said fifth gemstone provides illusion of said larger gemstone with a size greater than any of said four gemstones and said fifth gemstone, providing a pair of prongs arranged to form said square and said four gemstones are set to be held in respective positions by said pair of prongs.

8. The method of claim 7, wherein each of said four gemstones and said fifth gemstone comprises a diamond.

9. The method of claim 7, wherein all of said four gemstones are of the same diameter and depth and are circular in shape from a top view.

* * * * *